US009918559B2

(12) United States Patent
Osaki

(10) Patent No.: US 9,918,559 B2
(45) **Date of Patent: *Mar. 20, 2018**

(54) THREE-DIMENSIONAL NET-LIKE STRUCTURE

(71) Applicant: C-ENG CO., LTD., Gamagori-shi, Aichi-ken (JP)

(72) Inventor: Hiroko Osaki, Kariya (JP)

(73) Assignee: C-ENG CO., LTD., Gamagori-Shi, Aichi (JP)

( * ) Notice: Subject to any disclaimer, the term of this patent is extended or adjusted under 35 U.S.C. 154(b) by 903 days.

This patent is subject to a terminal disclaimer.

(21) Appl. No.: 14/364,324

(22) PCT Filed: Dec. 14, 2012

(86) PCT No.: PCT/JP2012/008013

§ 371 (c)(1),
(2) Date: Jun. 11, 2014

(87) PCT Pub. No.: WO2013/088736

PCT Pub. Date: Jun. 20, 2013

(65) Prior Publication Data

US 2014/0370769 A1 Dec. 18, 2014

(30) Foreign Application Priority Data

Dec. 14, 2011 (KR) ..... 10-2011-0134777

(51) Int. Cl.
*A47C 31/00* (2006.01)
*A47C 27/12* (2006.01)

(52) U.S. Cl.
CPC ..... *A47C 31/006* (2013.01); *A47C 27/122* (2013.01); *Y10T 442/10* (2015.04)

(58) Field of Classification Search
CPC .... A47C 31/006; A47C 27/122; Y10T 442/10
See application file for complete search history.

(56) References Cited

U.S. PATENT DOCUMENTS 4,095,007 A * 6/1978 Marshall ..... D04H 1/74 428/113
5,806,154 A * 9/1998 Tolbert ..... A41D 31/02 28/103

(Continued)

FOREIGN PATENT DOCUMENTS

JP 2008-295824 A 12/2008
JP 2010-154965 A 7/2010

(Continued)

OTHER PUBLICATIONS

Rogers, Some Studies on the Swelling Behavior of Polyethylene, Journal of Applied Polymer Science, vol. 14, pp. 1679, 1689, (1970).*

(Continued)

*Primary Examiner* — Elizabeth M Cole
(74) *Attorney, Agent, or Firm* — Matthias Scholl, PC; Matthias Scholl

(57) ABSTRACT

By taking into account the difficulty in smoothly bending along the shape of, for example, a care bed, there is provided a three-dimensional net-like structure made from polyethylene having a swelling ratio dependent on a shear rate such as to be 0.93 to 1.16 at a shear rate of 24.3 $sec^{-1}$ and 1.15 to 1.34 at a shear rate of 608 $sec^{-1}$ and having an MFR of 3 to 35 g/10 min and a density of 0.82 to 0.95 $g/cm^3$ and configured to have a spring structure of filaments randomly brought into contact with and tangled with one another, have a three-dimensional striped sparse-dense configuration in a lateral direction relative to an extrusion direction. The swelling ratio is shown as $D_2/D_1$ against shear rate when a molten thermoplastic resin is extruded to filaments from a capillary having a tube inner diameter $D_1$ of 1.0 mm and a length of 10 mm and $D_2$ denotes a diameter of cross section of the filaments extruded and cooled down.

7 Claims, 15 Drawing Sheets

(56) References Cited

U.S. PATENT DOCUMENTS

| | | | |
|---|---|---|---|
| 7,625,629 | B2 | 12/2009 | Takaoka |
| 7,892,991 | B2 | 2/2011 | Yamanaka et al. |
| 2006/0198983 | A1 | 9/2006 | Patel |

FOREIGN PATENT DOCUMENTS

| | | | |
|---|---|---|---|
| JP | 2010-279687 | A | 12/2010 |
| WO | 2006/068120 | A1 | 6/2006 |

OTHER PUBLICATIONS

J. Vlachopoulos et al., The role of rheology in polymer extrusion, [online], <URL: http://www.polydynamics.com/Rheology.pdf>.
V. Ganvir et al., Extrudate swell of linear and branched polyethylenes: ALE simulations and comparison with experiments, Journal of Non-Newtonian Fluid Mechanics, Jan. 2011, pp. 12-24, vol. 166, issue 1-2, Elsevier, Netherlands.

* cited by examiner (a)

(b)

(a)

(b)

(a)

(b)

THREE-DIMENSIONAL NET-LIKE STRUCTURE

This application is a 371 of PCT/JP2012/008013 filed Dec. 14, 2012.

TECHNICAL FIELD

The present invention relates to a three-dimensional net-like structure used for cushions, sofas and beds.

BACKGROUND ART

Patent Literature 1 discloses a three-dimensional net-like structure having voids formed by winding a resin yarn with an endless belt and a production method and a production apparatus of such a three-dimensional net-like structure. Patent Literature 2 discloses a three-dimensional net-like structure made from polyethylene as the material

CITATION LIST

Patent Literature

PTL 1: U.S. Pat. No. 7,625,629
PTL 2: U.S. Pat. No. 7,892,991

SUMMARY OF INVENTION

Technical Problem

When the three-dimensional net-like structure is used as a mattress for a care bed or a sofa bed, there is a need to smoothly bend the mattress along transformation of the bed. When the material used is a specific type of material having a high surface density, such as polyethylene, the texture of the three-dimensional net-like structure is unnaturally deformed with wrinkles or folds caused in the middle during bending of the three-dimensional net-like structure. There is accordingly a difficulty in smoothly bending the three-dimensional net-like structure along the shape of, for example, a care bed. There is also a general requirement in the field of medical treatment and nursing care to produce a mattress that is lighter in weight and has better durability, in order to relieve the load of nurses and care staff.

An object of the invention is accordingly to provide a smoothly-bendable three-dimensional net-like structure made from a thermoplastic resin.

Solution to Problem

The invention is a three-dimensional net-like structure made from polyethylene having a swelling ratio dependent on a shear rate and configured to have a curled spring structure of filaments randomly brought into contact with and tangled with each other, have a three-dimensional striped sparse-dense configuration in a lateral direction relative to an extrusion direction, and have a filament diameter of 0.2 to 1.3 mm and a bulk density of 0.01 to 0.2 g/cm$^3$, wherein the swelling ratio is shown as $D_2/D_1$ against shear rate when the polyethylene in molten state is extruded to the filaments from a capillary having a tube inner diameter $D_1$ of 1.0 mm and a length of 10 mm at a temperature of 190° C. and $D_2$ denotes a diameter of cross section of the polyethylene filaments extruded and cooled down.

The swelling ratio of the polyethylene is 0.93 to 1.16 at a shear rate of 24.3 sec$^{-1}$, is 1.00 to 1.20 at a shear rate of 60.8 sec$^{-1}$, is 1.06 to 1.23 at a shear rate of 121.6 sec$^{-1}$, is 1.11 to 1.30 at a shear rate of 243.2 sec$^{-1}$, is 1.15 to 1.34 at a shear rate of 608.0 sec$^{-1}$ and is 1.16 to 1.38 at a shear rate of 1216 sec$^{-1}$.

The polyethylene preferably has a melt flow rate (hereinafter abbreviated as MFR) of 3.0 to 35 g/10 min and a density of 0.82 to 0.95 g/cm$^3$.

Advantageous Effects of Invention

The three-dimensional net-like structure of the invention made from polyethylene having a specified swelling ratio and a specified density as the material has the three-dimensional striped sparse-dense configuration where sparse areas of low bulk density and dense areas of high bulk density appear alternately in an extrusion direction during production. The three-dimensional net-like structure is thus made adequately flexible in the extrusion direction and is smoothly bendable in the application to a mattress, for example, for a care bed or a sofa bed.

BRIEF DESCRIPTION OF DRAWINGS

FIG. 12(*a*) is a perspective view and FIG. 12(*b*) is a front view seen from an extrusion direction during production;

FIG. 13(*a*) is a perspective view and FIG. 13(*b*) is a front view seen from the extrusion direction during production;

FIG. 14(*a*) is a perspective view and FIG. 14(*b*) is a front view seen from the extrusion direction during production.

DESCRIPTION OF EMBODIMENTS

According to one embodiment, there is provided a three-dimensional net-like structure made from polyethylene having the characteristic of increasing the swelling ratio against the shear rate such that the swelling ratio is 0.93 to 1.16 at a shear rate of 24.3 $sec^{-1}$ and is 1.15 to 1.34 at a shear rate of 608.0 $sec^{-1}$ and having an MFR of 3.0 to 35 g/10 min and a density of 0.82 to 0.95 $g/cm^3$ and configured to have a curled spring structure of filaments randomly brought into contact with and tangled with one another, have a three-dimensional striped sparse-dense configuration in a lateral direction relative to an extrusion direction and have a filament diameter of 0.2 to 1.3 mm and a bulk density of 0.01 to 0.2 $g/cm^3$. The swelling ratio herein is shown as $D_2/D_1$ against the shear rate when molten polyethylene is extruded to filaments from a capillary having a tube inner diameter $D_1$ of 1.0 mm and a length of 10 mm at a temperature of 190° C. and $D_2$ denotes a diameter of cross section of the polyethylene filaments extruded and cooled down.

The present invention uses a thermoplastic resin having a specified swelling ratio, a specified MFR and a specified density as the raw material to provide a three-dimensional striped sparse-dense configuration and thereby enhance the bendability of a resulting three-dimensional net-like structure having the three-dimensional striped sparse-dense configuration. The thermoplastic resin material used in the invention is polyethylene and more specifically a linear low-density polyethylene (LLDPE) or a very low density polyethylene (VLPE). The density of the polyethylene material is preferably 0.82 to 0.95 $g/cm^3$ and is more preferably 0.85 to 0.94 $g/cm^3$.

Figure 12:
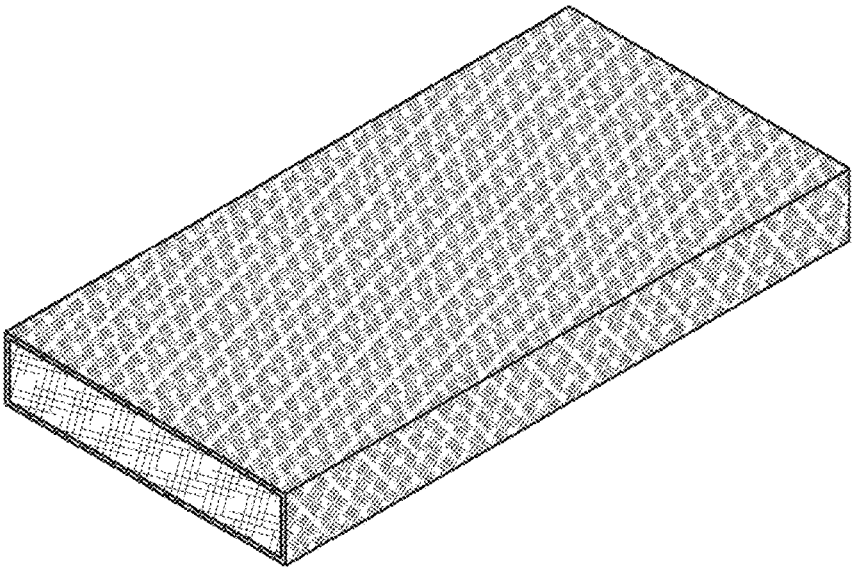
FIG. 12 is diagrams illustrating a three-dimensional net-like structure having a surface layer (densely-shaped outer peripheral area) according to an embodiment of the invention.
Figure 12:
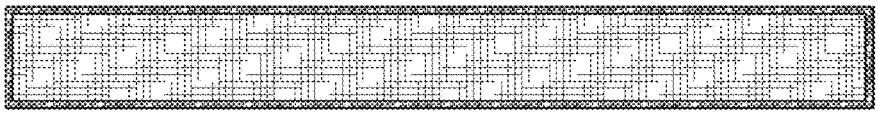
Figure 13:
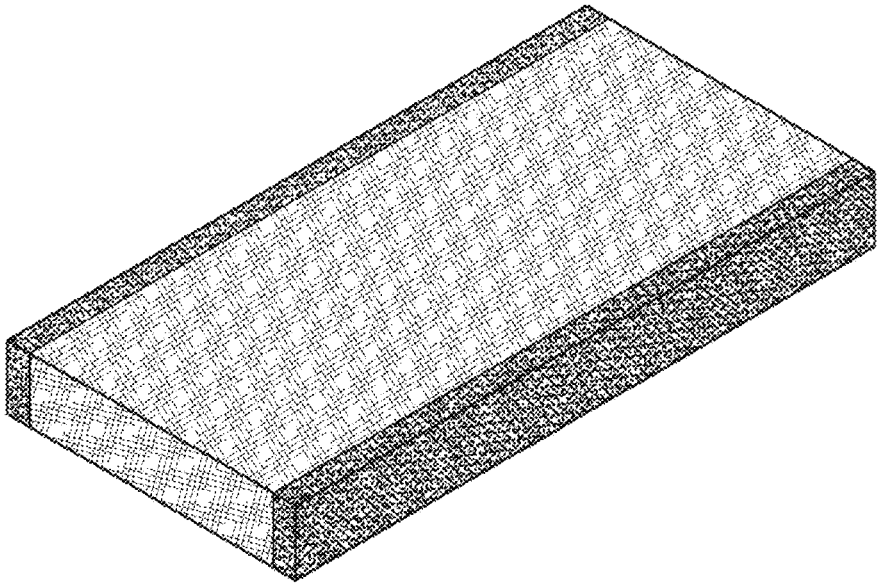
FIG. 13 is diagrams illustrating a three-dimensional net-like structure having both side areas of the increased bulk density (densely-hatched both side areas) according to another embodiment of the invention.
Figure 13:
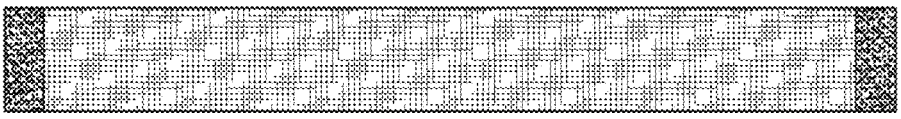
Figure 14:
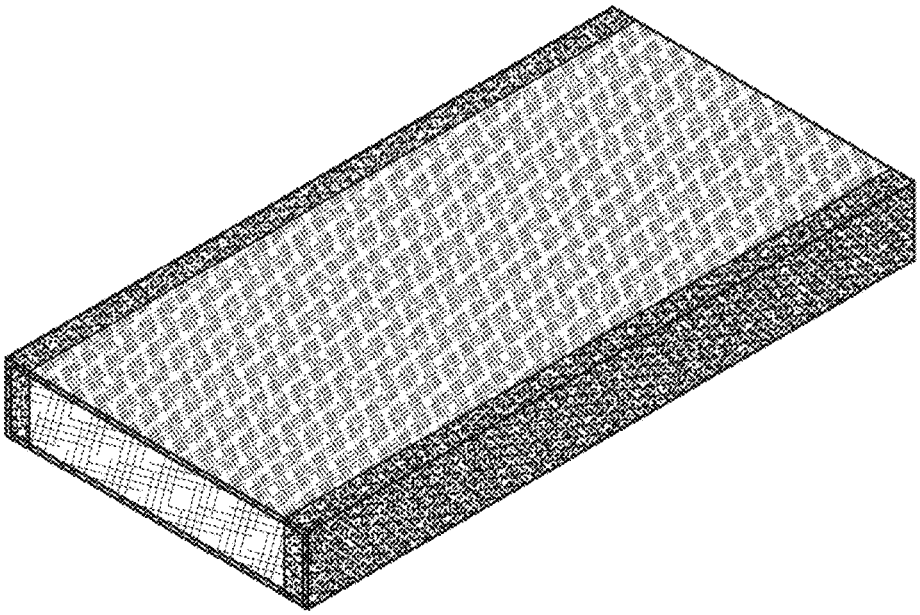
FIG. 14 is diagrams illustrating a three-dimensional net-like structure having a surface layer (densely-shaded outer peripheral area) and both side areas of the increased bulk density (densely-hatched both side areas) according to another embodiment of the invention.
Figure 14:
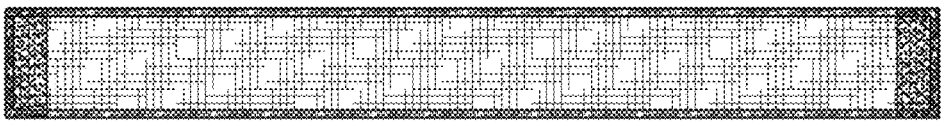

For example, Patent Literatures 1 and 2 should be referred to for the detailed production method of the three-dimensional net-like structure. The invention is applicable to a three-dimensional net-like structure having a surface layer of the higher bulk density than the other area on its outer periphery (FIG. 12). The invention is also applicable to a three-dimensional net-like structure having both side areas of the higher bulk density than the other area (FIG. 13). The invention is further applicable to a three-dimensional net-like structure having a surface layer and both side areas of the higher bulk density than the other area (FIG. 14). The bulk density of the three-dimensional net-like structure is preferably 0.01 to 0.2 $g/cm^3$. The areas of the higher bulk density, such as the surface area may, however, need not to have the bulk density of this range.

The swelling ratio denotes a value by dividing the diameter of the extruded resin by the diameter of the capillary when the molten resin is extruded from the capillary which is a thin cylindrical tube and is dependent on the shear rate. More specifically, the swelling ratio herein is shown as $D_2/D_1$, where $D_1$ denotes the diameter of the capillary (tube inner diameter) used to extrude the molten thermoplastic resin to filaments and $D_2$ denotes the diameter of the cross section of the extruded filament. The following describes the shear rate dependency of the swelling ratio and a measurement test for the relevant shear rate dependency of the melt viscosity. Samples A to F were prepared according to the embodiment of the invention. Samples A to D used a very low density polyethylene (VLPE) as the material, and Samples E and F used a linear low-density polyethylene (LLDPE) as the material. Sample G was a comparative example of a prior art product made from an ethylene-vinyl acetate copolymer resin (EVA).

The following describes a measurement method and a measurement device of the swelling ratio. The same measurement device as that for a melt indexer (MI) to measure the melt flow rate (MFR) is employed for the measurement device of the swelling ratio. CAPILOGRAPH 1D (manufactured by Toyo Seiki Seisaku-sho, Ltd.) was used for this purpose. The material resin is extruded at an extrusion rate of 3 g/10 min under application of a pressure on the capillary having the tube inner diameter $D_1$ of 1.0 mm and the length of 10 mm at the temperature of 190° C. The filaments of the extruded material resin are cooled down with an alcohol. $D_2$ denotes the diameter of the cross section of the filament. The swelling ratio is calculated as $D_2/D_1$. The swelling ratio was measured at different shear rates of the material resin.

The relationship between the swelling ratio and the shear rate is described. The swelling ratio is dependent on the shear rate and increases with an increase in shear rate. The shear rate denotes a temporal change of shear deformation and is synchronous with velocity gradient. When two parallel layers distant from each other by "a" (cm) has a velocity difference "b" (cm/sec), the shear rate is expressed as b/a (1/sec).

An apparent shear rate is given by the following calculation formula. In the description hereof, the apparent shear rate as average value is used as the shear rate.

$$\gamma=4Q/\pi r^3$$

where $\gamma$ denotes the apparent shear rate ($sec^{-1}$), r denotes the radius (cm) of the capillary, and Q denotes the flow rate ($cm^3/sec$).

When $\tau$ denotes an apparent shear stress and $\eta$ denotes an apparent melt viscosity, the apparent melt viscosity is given as:

$$\eta=\tau/\gamma$$

A flat nozzle having a ratio $L/D_1$=10 mm/1.0 mm was used for measurement at the measurement temperature of 190° C., where L denotes the length of the capillary and $D_1$ denotes the diameter of the capillary. CAPILOGRAPH manufactured by Toyo Seiki Seisaku-sho, Ltd. was used as the measurement device.

Figure 1:
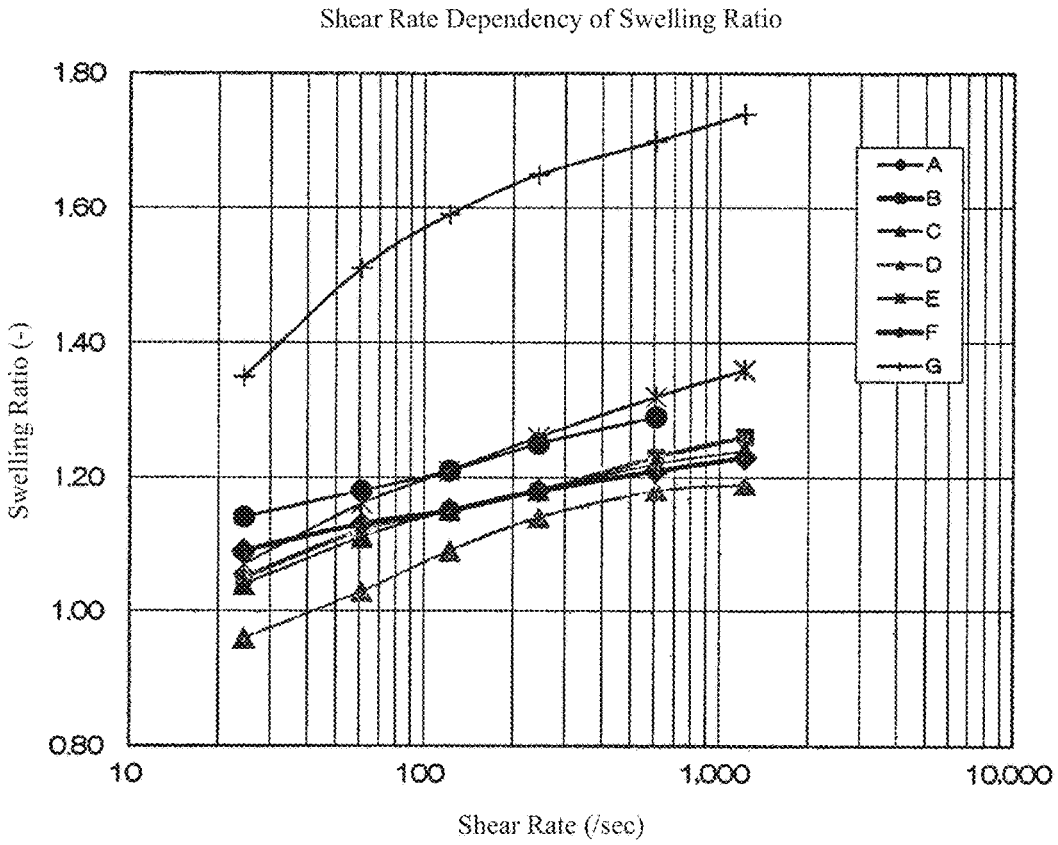
FIG. 1 is a graph showing shear rate dependency of swelling ratio of three-dimensional net-like structures according to an embodiment of the invention.

Table 1 shows the results of measurement on the shear rate dependency of the swelling ratio. FIG. 1 is a graph corresponding to Table 1. The plots in the graph of FIG. 1 show the tendency of increasing the swelling ratio with an increase in shear rate. These measurement results have no decrease in swelling ratio with an increase in shear rate. The invention is applied even in the event of an exceptional decrease in swelling ratio with an increase in shear rate due to, for example, a measurement error during specific measurement.

The preferable range of the swelling ratio is 0.93 to 1.16 at a shear rate of 24.3 $sec^{-1}$, is 1.00 to 1.20 at a shear rate of 60.8 $sec^{-1}$, is 1.06 to 1.23 at a shear rate of 121.6 $sec^{-1}$, is 1.11 to 1.30 at a shear rate of 243.2 $sec^{-1}$, is 1.15 to 1.34 at a shear rate of 608.0 $sec^{-1}$ and is 1.16 to 1.38 at a shear rate of 1216 $sec^{-1}$. The swelling ratio set to the preferable range forms a three-dimensional striped sparse-dense configuration in the direction orthogonal to the extrusion direction and accordingly provides a three-dimensional net-like structure with the high bendability as shown in FIGS. 3 to 6.

TABLE 1

Shear Rate Dependency of Swelling Ratio

| Product | MFR (g/10 min) | Density ($g/cm^3$) | Swelling Ratios at Different Shear Rates (Pa · s) 24.3 | 60.8 | 121.6 | 243.2 | 608.0 | 1,216 |
|---|---|---|---|---|---|---|---|---|
| A | 3.5 | 0.880 | 1.14 | 1.18 | 1.21 | 1.25 | 1.29 | |
| B | 12 | 0.907 | 1.05 | 1.12 | 1.15 | 1.18 | 1.23 | 1.26 |
| C | 16.5 | 0.898 | 1.04 | 1.11 | 1.15 | 1.18 | 1.22 | 1.24 |
| D | 30 | 0.880 | 0.96 | 1.03 | 1.09 | 1.14 | 1.18 | 1.19 |
| E | 16 | 0.921 | 1.07 | 1.16 | 1.21 | 1.26 | 1.32 | 1.36 |
| F | 12 | 0.905 | 1.09 | 1.13 | 1.15 | 1.18 | 1.21 | 1.23 |
| G | 14 | 0.934 | 1.35 | 1.51 | 1.59 | 1.65 | 1.70 | 1.74 |

Measurement Method:

Measurement device: CAPILOGRAPH manufactured by Toyo Seiki Seisaku-sho, Ltd.

Measurement temperature: 190° C.

Capillary: Flat nozzle having L/D=10 mm/1.0 mm

Figure 2:
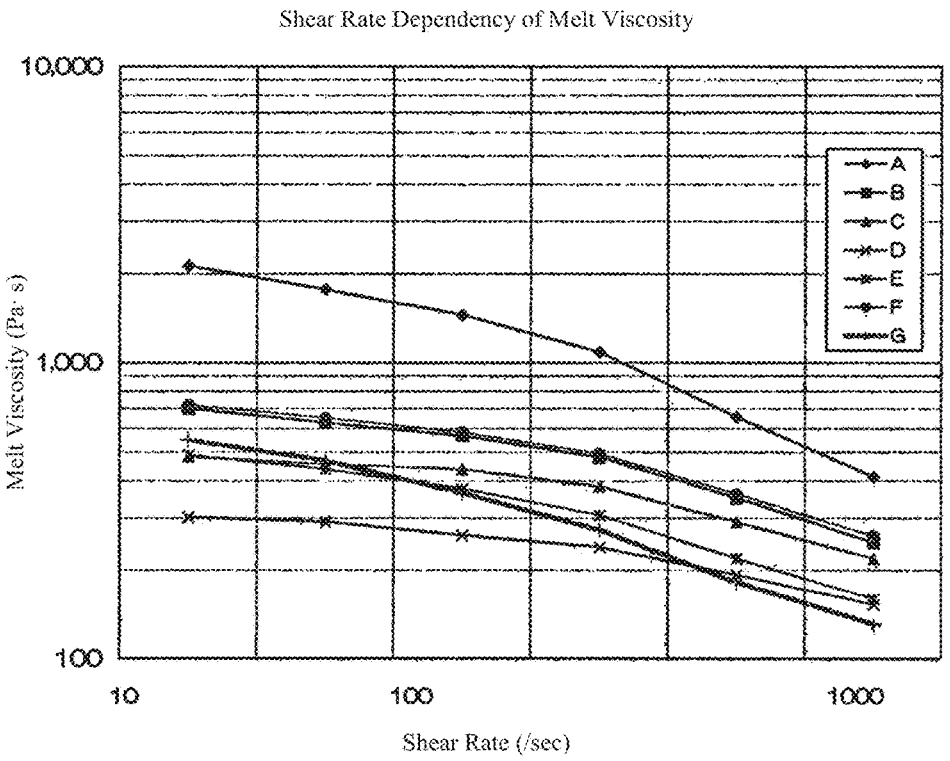
FIG. 2 is a graph showing shear rate dependency of melt viscosity of the three-dimensional net-like structures according to the embodiment of the invention.

Table 2 shows the results of measurement on the shear rate dependency of the melt viscosity. FIG. 2 is a graph corresponding to Table 2. The plots in the graph of FIG. 2 are decreasing curves.

TABLE 2

Shear Rate Dependency of Melt Viscosity

| Product | MFR (g/10 min) | Density ($g/cm^3$) | Melt Viscosities at Different Shear Rates (Pa · s) 24.3 | 60.8 | 121.6 | 243.2 | 608.0 | 1,216 |
|---|---|---|---|---|---|---|---|---|
| A | 3.5 | 0.880 | 2,128 | 1,772 | 1,446 | 1,086 | 656 | 414 |
| B | 12 | 0.907 | 700 | 629 | 567 | 481 | 351 | 248 |
| C | 16.5 | 0.898 | 483 | 456 | 438 | 384 | 291 | 219 |
| D | 30 | 0.880 | 302 | 292 | 263 | 239 | 193 | 153 |
| E | 16 | 0.921 | 489 | 438 | 377 | 307 | 219 | 160 |
| F | 12 | 0.905 | 721 | 652 | 583 | 494 | 362 | 261 |
| G | 14 | 0.934 | 550 | 468 | 365 | 274 | 182 | 131 |

Measurement Method:

Measurement device: CAPILOGRAPH manufactured by Toyo Seiki Seisaku-sho, Ltd.

Measurement temperature: 190° C.

Capillary: Flat nozzle having L/D=10 mm/1.0 mm

In general, an organic high-molecular material such as polymer has entangled molecules during flow. These tangles are likely to be released by the shear force during flow. The melt viscosity accordingly decreases with an increase in shear rate as shown in Table 2. The decrease in melt viscosity leads to a decrease in swelling ratio. The swelling ratio is, however, affected by the extrusion pressure more significantly, so that the swelling ratio tends to increase with an increase in shear rate as shown in Table 1. Especially using polyethylene having less entangled molecules has a remarkable tendency of providing the small swelling ratio at the low shear rate and increasing the swelling ratio with an increase in shear rate.

The following describes control of the swelling ratio D2/D1 in production of the three-dimensional net-like structure. As understood from Table 1, the swelling ratio increases with an increase in shear rate, i.e., with an increase in extrusion rate. At a fixed shear rate, the material having the lower MFR has the higher swelling ratio. At a fixed shear rate, the lower molding temperature causes the higher swelling ratio. Under the conditions of fixed shear rate, material composition and molding temperature, the lower take-over speed causes the higher swelling ratio. The swelling ratio also increases with a decrease in air gap (distance between the capillary and the cooling water surface). The swelling ratio increases with an increase in ratio $L/D_1$ of the length L to the diameter $D_1$ of the capillary.

The following describes the repulsive force of the three-dimensional net-like structure according to the embodiment of the invention. The repulsive force of the three-dimensional net-like structure varies with a variation of the swelling ratio or the bulk density of the material. The repulsive force was measured by a load applied to compress each sample by 10 mm via a disk of 150 mm. More specifically, a load was applied in a middle area of each mattress as a sample, and the forces applied to sink the mattress by 10 mm, 20 mm and 30 mm were measured as the repulsive forces. The measurement devices used were a digital force gauge ZPS and a load cell ZPS-DPU-1000N manufactured by IMADA CO., LTD. Under the same manufacturing conditions including the take-over speed of a haul-off machine, the three-dimensional net-like structure made of polyethylene having the specified swelling ratio and the specified density according to the embodiment of the invention had less sinks by 14 to 30% in the 80000 repeated 50%-compression test, compared with a product of three-dimensional net-like structure made of EVA as the material. During production of the three-dimensional net-like structure, the fibers form the striped structure in the resin flow direction, which reduces the amount of the material resin by 10 to 25% at the equivalent repulsive force. The product weight at a fixed repulsive force is also reduced by 10% or more.

In the three-dimensional net-like structure having the surface layer according to the embodiment of the invention, the high bulk density of the surface layer causes the three-dimensional net-like structure not to be bendable or not to be easily bendable. In order to bend the three-dimensional net-like structure well, the thickness of the surface layer is preferably 0.3 to 3.5 mm. Preferably, the weight range of the surface layer is 0.05 to 1.0 g (measured for the dimensions of 30 mm in length×30 mm in width×4 m in thickness; converted bulk density of 0.014 to 0.278 $g/cm^3$), and the filament diameter of the surface layer is 0.1 to 2.0 mm. Especially preferably, the weight range of the surface layer of the three-dimensional net-like structure is 0.10 to 0.9 g (converted bulk density of 0.028 to 0.250 $g/cm^3$), and the filament diameter of the surface layer is 0.2 to 1.3 mm. Most preferably, the weight range of the surface layer of the three-dimensional net-like structure is 0.4 to 0.8 g (converted bulk density of 0.111 to 0.222 $g/cm^3$), and the filament diameter of the surface layer is 0.3 to 1.0 mm.

Figure 3:
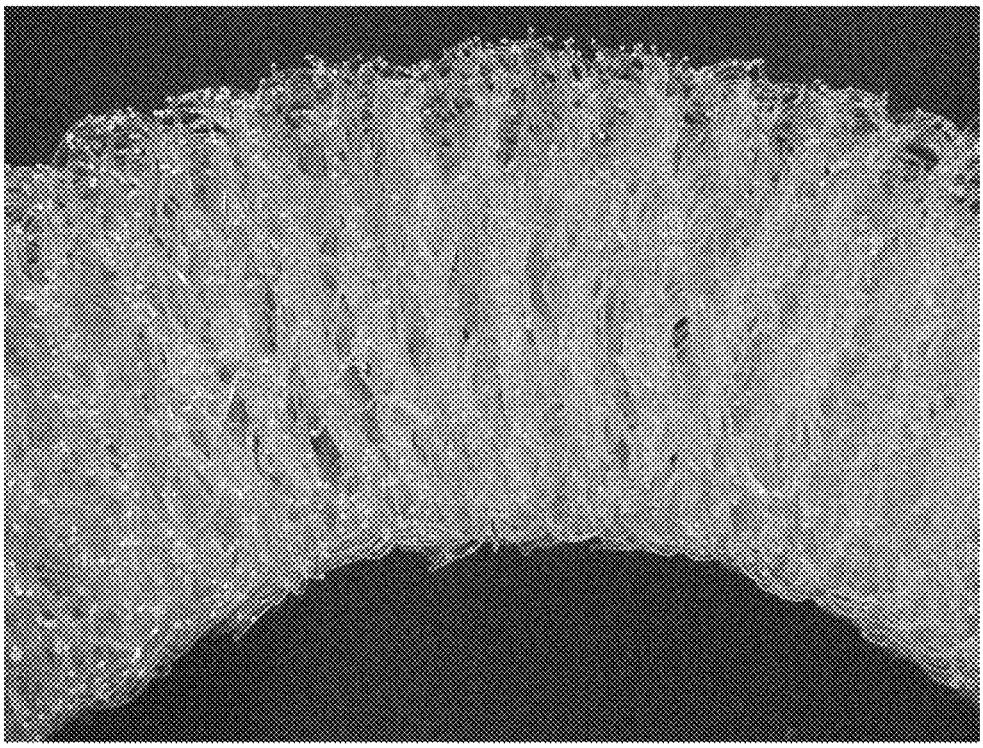
FIG. 3 is a side view photograph of a three-dimensional net-like structure according to an embodiment of the invention in the bent state.
Figure 4:
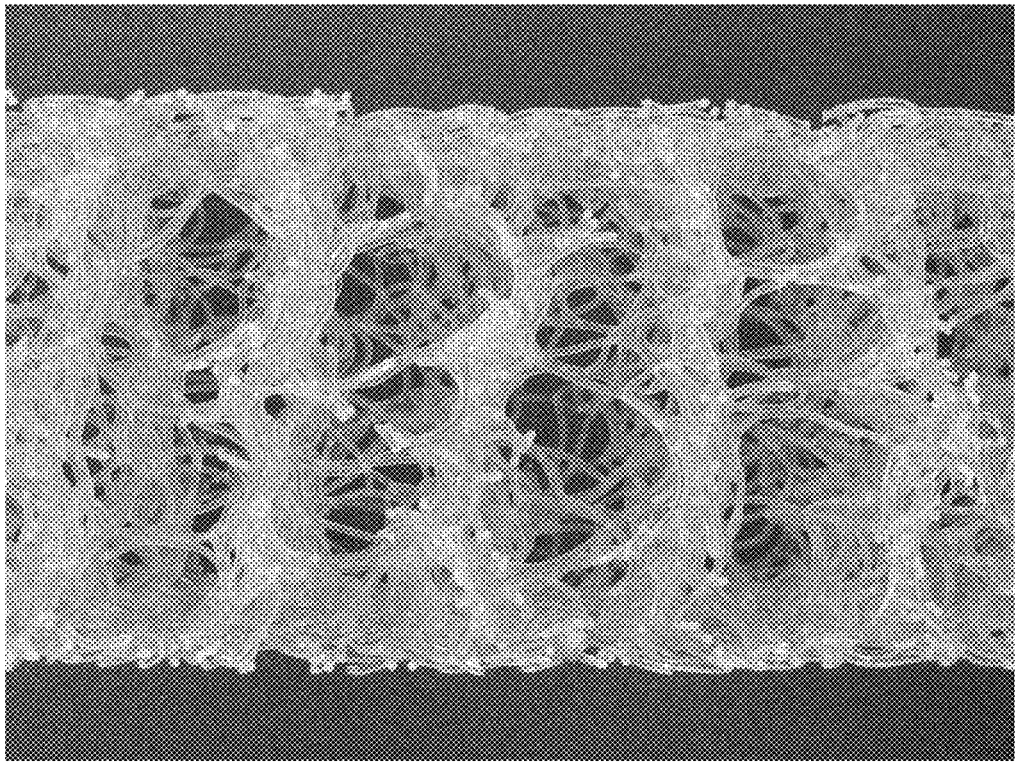
FIG. 4 is a side view photograph of the three-dimensional net-like structure according to the embodiment of the invention in the non-bent state.
Figure 5:
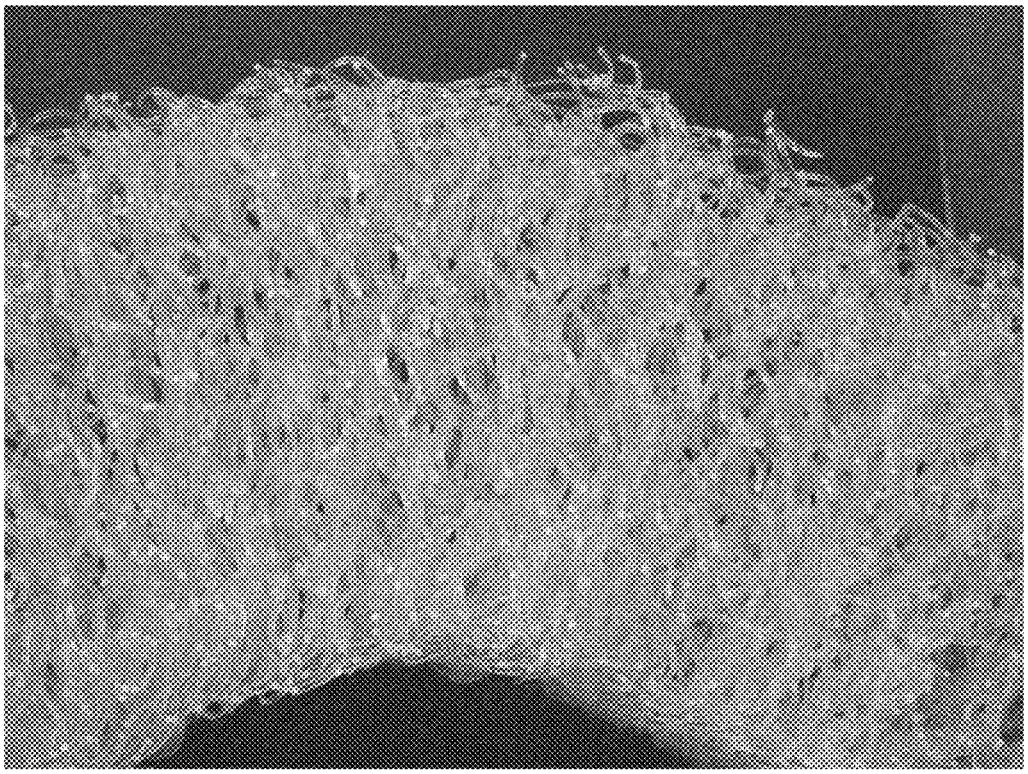
FIG. 5 is a side view photograph of a three-dimensional net-like structure according to another embodiment of the invention in the bent state.
Figure 6:
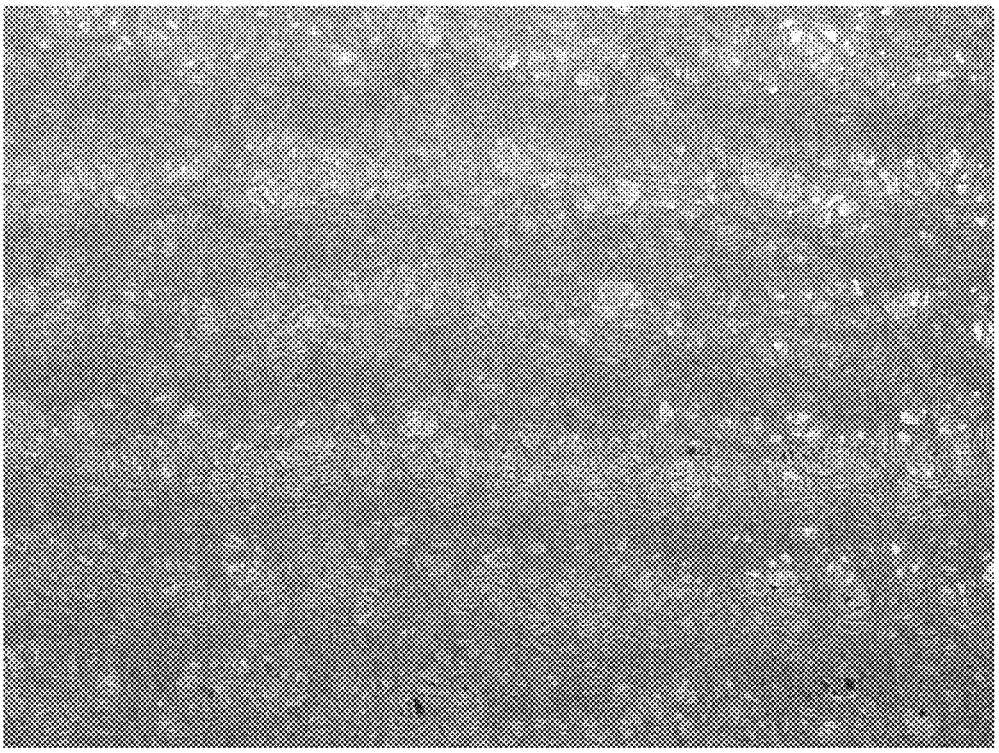
FIG. 6 is a side view photograph of the three-dimensional net-like structure according to the embodiment of the invention in the non-bent state.
Figure 7:
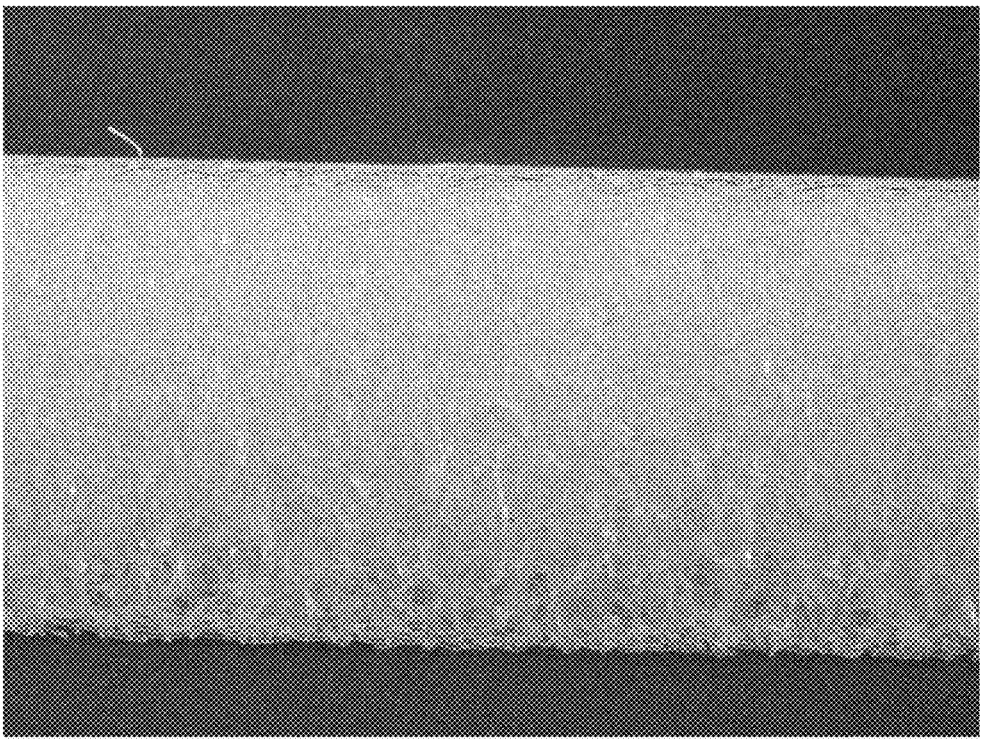
FIG. 7 is a side view photograph of a three-dimensional net-like structure of a comparative example in the non-bent state.
Figure 8:
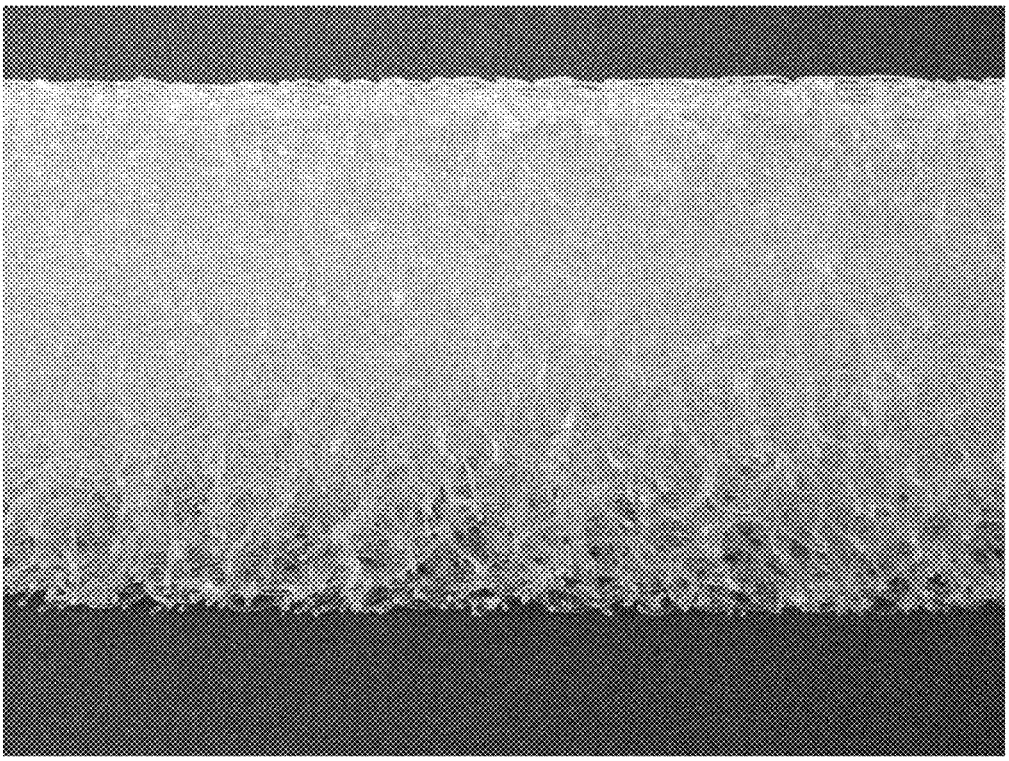
FIG. 8 is a side view photograph of a three-dimensional net-like structure of another comparative example in the non-bent state.
Figure 9:
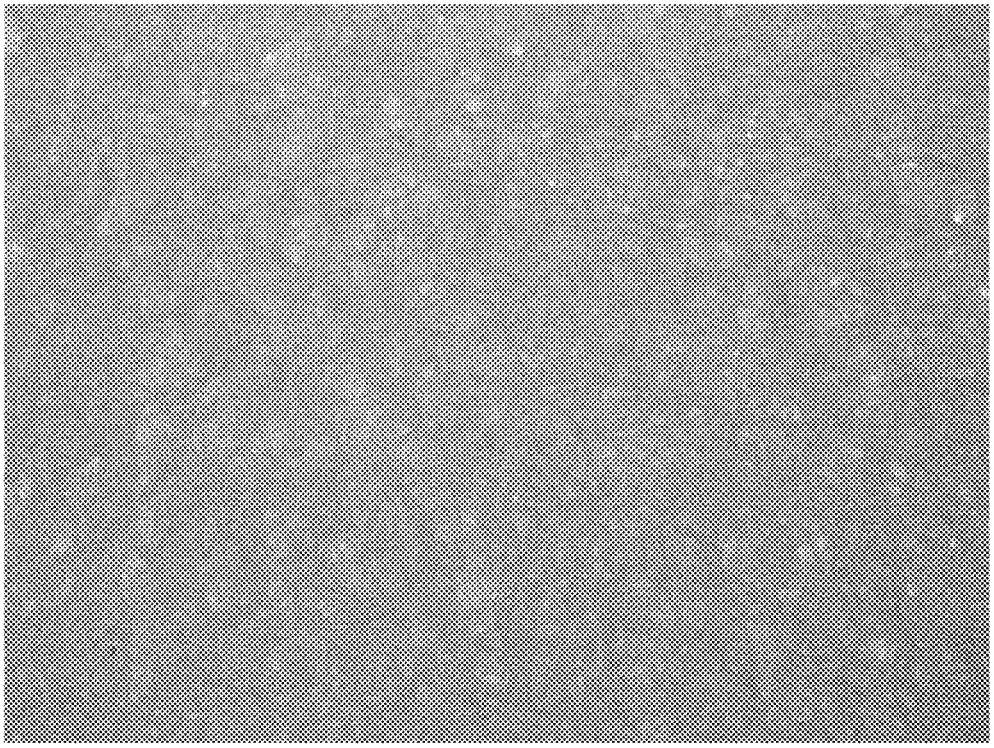
FIG. 9 is a side view photograph of a three-dimensional net-like structure of another comparative example in the non-bent state.
Figure 10:
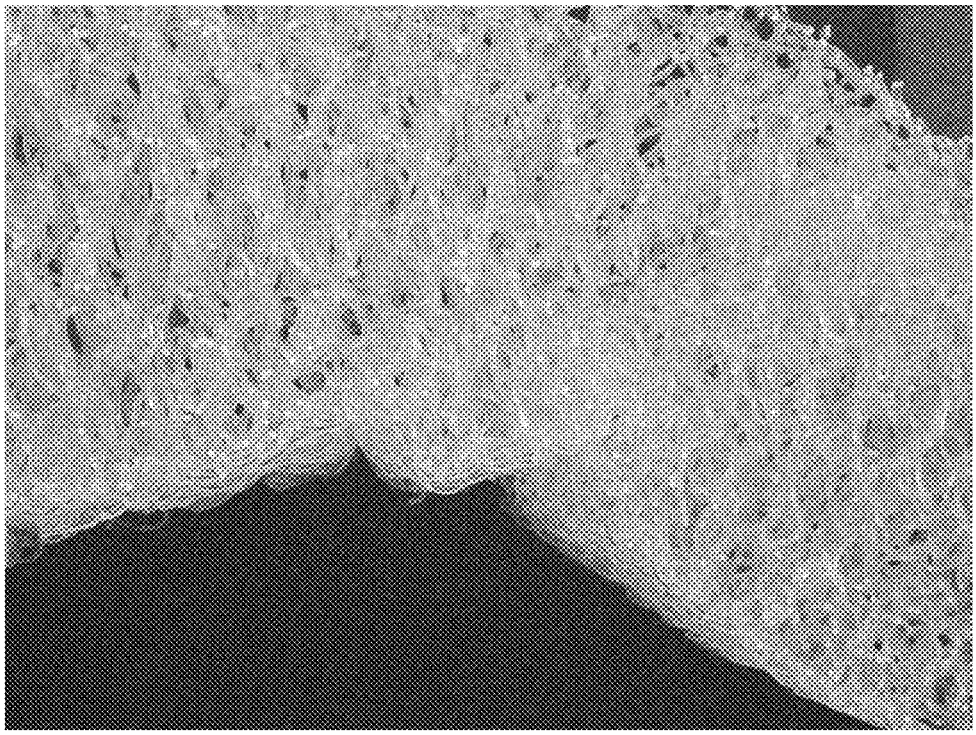
FIG. 10 is a side view photograph of the three-dimensional net-like structure of the comparative example in the bent state.
Figure 11:
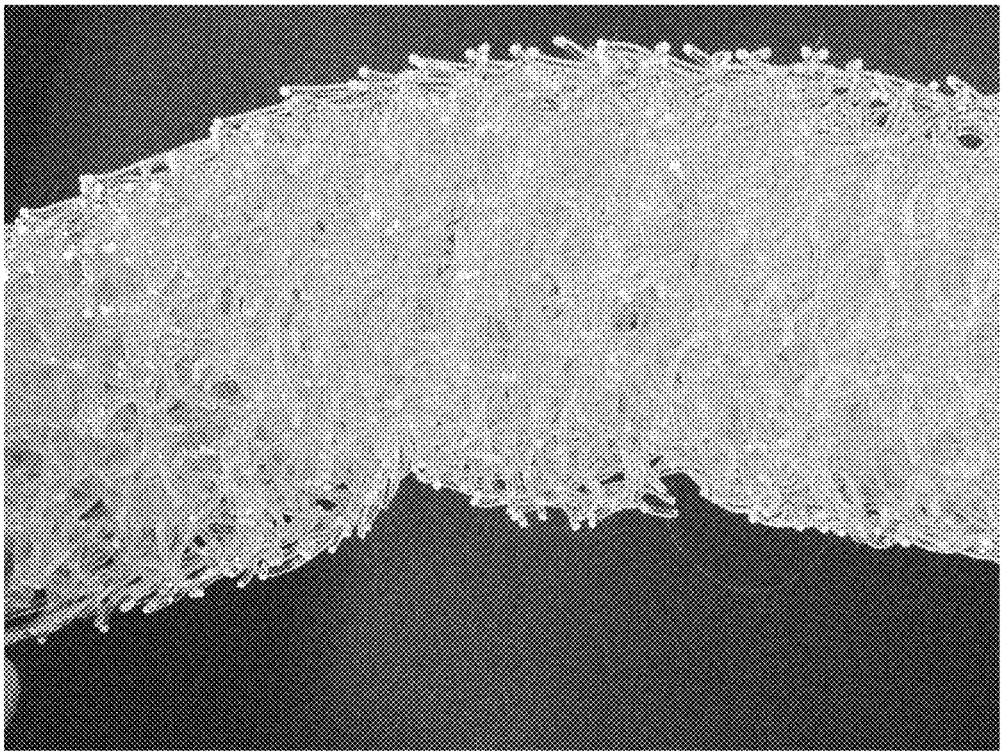
FIG. 11 is a side view photograph of the three-dimensional net-like structure of the comparative example in the bent state.

FIGS. 3 to 6 show three-dimensional net-like structures according to embodiments of the invention in the bent state or in the non-bent state. FIGS. 7 to 11 show prior art three-dimensional net-like structures as comparative examples in the bent state or in the non-bent state. The three-dimensional net-like structures according to the embodiments of the invention have the three-dimensional striped sparse-dense configuration (FIGS. 4 and 6) and thereby cause no substantial wrinkles inside of a bend in the bent state (FIG. 3). The prior art structure, on the other hand, does not have the three-dimensional striped sparse-dense configuration (FIGS. 7 to 9) and causes irregular wrinkles inside of a bend in the bent state (FIGS. 10 and 11). In an application of the three-dimensional net-like structure to a bed mattress, such wrinkles cause poor usability and early deterioration of the product. The three-dimensional net-like structure according to the embodiment of the invention suppresses the occurrence of such irregular wrinkles and solves such potential problems.

A three-dimensional net-like structure having a sparse-dense configuration has conventionally been producible by increasing and decreasing the take-over speed of a haul-off machine. The resulting sparse-dense configuration, however, has randomly-arranged sparse-dense repeating units or large sparse-dense repeating units and accordingly has a difficulty in bending smoothly. The frequent speed change of the haul-off machine also causes a problem of low production efficiency. An embodiment of the invention, on the other hand, uses polyethylene having the specified swelling ratio and the specified density described above as the material to form a three-dimensional striped sparse-dense configuration having the adequate sparse-dense repeating units and produce a smoothly-bendable three-dimensional net-like structure without reducing the production efficiency. Additionally, the embodiment of the invention is applicable to the increasing and decreasing take-over speed of the haul-off machine, as well as to the constant take-over speed of the haul-off machine. This contributes to production of three-dimensional net-like structures of various properties.

In general, the three-dimensional net-like structure having the surface layer is not easily bendable and causes irregular wrinkles under application of an increased bending load. Another embodiment of the invention is a three-dimensional net-like structure having a surface layer as shown in FIG. 12. This three-dimensional net-like structure is more easily bendable, compared with the prior art three-dimensional net-like structure. Even if some wrinkles are caused by bending the three-dimensional net-like structure, the three-dimensional striped sparse-dense configuration prevents no unnatural deformation of the filament structure but causes regular streaks along the three-dimensional striped sparse-dense configuration. This minimizes the poor usability and the early deterioration of the product described above. The three-dimensional striped sparse-dense configuration ensures the good water permeation and the good water drainage to be dried quickly. The three-dimensional net-like structure according to the embodiment of the invention is thus favorably applied to mattresses for medical use, which are to be made readily washable.

The three-dimensional net-like structure having the increased bulk density on both sides is also not easily bendable. Another embodiment of the invention is such a three-dimensional net-like structure (FIG. 13). In an application of such a three-dimensional net-like structure to a mattress for medical use, bending of the mattress assists the patient's sitting posture for a long time. The harder sides of the mattress assist the patient to readily and steadily stand from the bed and enable the patient to sit on the edge of the bed. Another embodiment of the invention is a three-dimensional net-like structure having a surface layer and the increased bulk density on both sides (FIG. 14).

Another preferable embodiment of the invention is a three-dimensional net-like structure formed in a curved, different shape, for example, a seat cushion. The seat cushion of the three-dimensional net-like structure has the three-dimensional striped sparse-dense configuration and is thus readily bendable, light in weight and breathable. The sparse areas having the relatively high void ratio in the three-dimensional striped sparse-dense configuration has better air permeability, compared with the dense areas. This efficiently enables a disinfectant or a refresher sprayed on the seat cushion to be readily and homogeneously spread over the entire seat cushion.

In an application of the three-dimensional net-like structure according to the embodiment of the invention to, for example, a seat cushion, a person may feel some irregularities on the seat surface caused by the three-dimensional striped sparse-dense configuration. In order to relieve this problem, a surface layer may be provided on the three-dimensional net-like structure. A laminate material made of another material or the same material may be bonded to or thermally molded with the three-dimensional net-like structure according to the embodiment of the invention. This also solves the potential problem of the seat surface.

Figure 15:
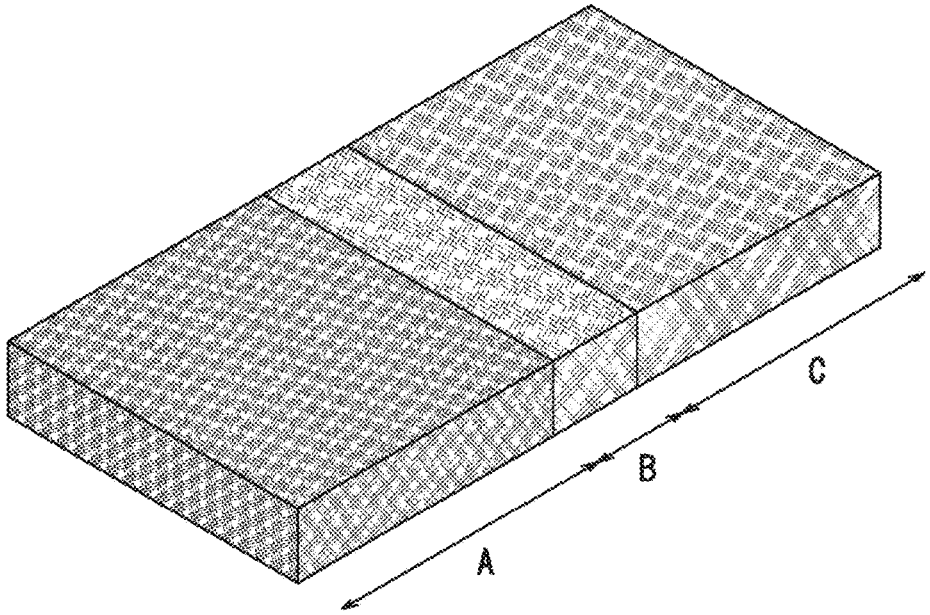
FIG. 15 is a perspective view illustrating an example of varying the bulk density in application of the three-dimensional net-like structure according to the embodiment of the invention to a seat, wherein the longitudinal direction corresponds to the extrusion direction during production.

In an application of the three-dimensional net-like structure to, for example, an automobile seat, the conventional three-dimensional net-like structure is not readily bendable, so that a seat member and a back member are generally formed by separately produced, different three-dimensional net-like structures. The three-dimensional net-like structure according to the embodiment of the invention is, on the other hand, readily bendable, so that a seat member and a back member can be formed by bending and folding one single three-dimensional net-like structure. One embodiment of the invention is a three-dimensional net-like structure having the three-dimensional striped sparse-dense configuration and the more significantly varying bulk density by increasing and decreasing the take-over speed. For example, as shown in FIG. 15, an area A is formed to have a high bulk density and to be used for a seat member; an area B is formed to have a low bulk density and to be used for a bend between the seat member and a back member; and an area C is formed to have an intermediate bulk density which is higher than that of the bend but is lower than that of the seat member and to be used for the back member. This provides the seat with the sufficient performances such as comfortableness, while allowing for the simplified production and assembly of the integral three-dimensional net-like structure, thus reducing the manufacturing cost.

Mixing an antimicrobial agent, a flame retardant or a non-combustible material with the thermoplastic resin material changes the specific gravity and the viscosity and forms a three-dimensional net-like structure that is not readily bendable. The embodiment of the invention is, however, applicable to the material mixed with such additives. This enables production of a three-dimensional net-like structure having the non-combustible, flame-retardant and antimicrobial abilities and the improved bendability by the three-dimensional striped sparse-dense configuration.

The following describes the relationship between the various conditions of an extruder and a haul-off machine used for production of three-dimensional net-like structures as measurement samples and the bulk density for bending the three-dimensional net-like structure well. Three-dimensional net-like structures having a thickness of 80 mm and a width of 270 mm were produced with an extruder having the screw diameter of 40 mm and a nozzle having the capillary diameter (nozzle diameter) of 1.0 mm. At the screw rotation speed of 60 rpm (extrusion rate of about 14 kg/hour), the take-over speed of the haul-off machine and the bulk density for bending the three-dimensional net-like structure well were respectively in the range of 1.7 to 3.2 mm/sec and in the range of 0.0303 to 0.0563 g/cm$^3$. For example, under the conditions of the screw rotation speed of 60 rpm, the haul-off machine take-over speed of 2.9 mm/sec and the bulk density of 0.0502 g/cm$^3$, some wrinkles were observed on the surface when the three-dimensional net-like structure was bent. Under the conditions of the screw rotation speed of 60 rpm, the haul-off machine take-over speed of 3.1 mm/sec and the bulk density of 0.0446 g/cm$^3$, on the other hand, the three-dimensional net-like structure was bent well. In the three-dimensional net-like structure having a surface layer, the bulk density and the filament diameter of the surface layer for bending the three-dimensional net-like structure well were respectively in the range of 0.13 to 0.27 g/cm$^3$ and in the range of 0.1 to 1.2 mm. For example, under the conditions of the screw rotation speed of 60 rpm and the haul-off machine take-over speed of not higher than 2.9 mm/sec, the bulk density of the surface layer exceeded 0.27 g/cm$^3$ and some wrinkles were observed when the three-dimensional net-like structure was bent. The above measurement values were obtained on the assumption that the surface layer ranged from the surface to the depth of 4 mm of the three-dimensional net-like structure having the thickness of 80 mm and the width of 270 mm described above. The combination of the bulk density and the filament diameter in these ranges enables the three-dimensional net-like structure having the varying bulk density in the thickness direction with a variation in nozzle diameter or a variation in number of nozzle holes to be bent well.

INDUSTRIAL APPLICABILITY

The three-dimensional net-like structure of the invention is applicable to cushions, sofas, beds (mattresses) and seats (other than sofas).

The invention claimed is:

1. A three-dimensional netted structure bendable in the direction of the extrusion direction made from a very low density polyethylene (VLPE) or a linear low-density polyethylene (LLDPE) having a swelling ratio dependent on a shear rate and configured to have a curled spring structure of filaments randomly brought into contact with and tangled with each other, have a three-dimensional striped sparse-dense configuration in a lateral direction relative to an extrusion direction, and have a filament diameter of 0.2 to 1.3 mm and a bulk density of 0.01 to 0.2 g/cm$^3$, wherein the swelling ratio is shown as $D_2/D_1$ against shear rate when the polyethylene in molten state is extruded to the filaments from a capillary having a tube inner diameter $D_1$ of 1.0 mm and a length of 10 mm at a temperature of 190° C. and $D_2$ denotes a diameter of a cross section of the polyethylene filaments extruded and cooled down;

the swelling ratio of the polyethylene is 0.93 to 1.16 at a shear rate of 24.3 sec$^{-1}$, the swelling ratio of the polyethylene is 1.00 to 1.20 at a shear rate of 60.8 sec$^{-1}$, the swelling ratio of the polyethylene is 1.06 to 1.23 at a shear rate of 121.6 sec$^{-1}$, the swelling ratio of the polyethylene is 1.11 to 1.30 at a shear rate of 243.2 sec$^{-1}$, the swelling ratio of the polyethylene is 1.15 to 1.34 at a shear rate of 608.0 sec$^{-1}$, or the swelling ratio of the polyethylene is 1.16 to 1.38 at a shear rate of 1216 sec$^{-1}$; and the three-dimensional netted structure has a surface layer in the extrusion direction which has a higher bulk density than the other area.

2. A three-dimensional structure, the three-dimensional structure comprising polyethylene filaments, each of the polyethylene filaments being produced by extruding polyethylene in molten state through a capillary at a temperature of 190° C. to form an intermediate polyethylene filament and then cooling down the intermediate polyethylene filament, the polyethylene in the molten state having a shear rate;

wherein:

the polyethylene filaments have a curled spring shape and are randomly contacted and tangled with each other;

the three-dimensional structure comprises a plurality of sparse portions, a plurality of dense portions, and a surface layer;

the surface layer is in a sheet shape and has a sheet surface;

each of the plurality of sparse portions has a first density;

each of the plurality of dense portions has a second density;

the surface layer has a third density;

the first density is lower than the second density;

the second density is lower than the third density;

each of the plurality of sparse portions and each of the plurality of dense portions are disposed alternately along the sheet surface to form a sparse-dense configuration;

the polyethylene filaments have a filament diameter of 0.2 to 1.3 mm and a bulk density of 0.01 to 0.2 g/cm$^3$;

the polyethylene filaments have a swelling ratio;

the swelling ratio is defined as $D_2/D_1$, wherein D1 denotes an inner diameter of the capillary and is 1.0 mm, and the capillary has a length of 10 mm, and $D_2$ denotes a diameter of a cross section of the polyethylene filaments; and the swelling ratio is 0.93 to 1.16 when the shear rate is 24.3 sec$^{-1}$, the swelling ratio is 1.00 to 1.20 when the shear rate is 60.8 sec$^{-1}$, the swelling ratio is 1.06 to 1.23 when the shear rate is 121.6 sec$^{-1}$, is 1.11 to 1.30 when the shear rate is 243.2 sec$^{-1}$, the swelling ratio is 1.15 to 1.34 when the shear rate is 608.0 sec$^{-1}$, or the swelling ratio is 1.16 to 1.38 when the shear rate is 1216 sec$^{-1}$.

3. The three-dimensional structure of claim 2, wherein the polyethylene filaments comprise an antimicrobial agent.

4. The three-dimensional structure of claim 2, wherein the polyethylene is a linear low-density polyethylene (LLDPE) or a very low density polyethylene (VLPE); and the polyethylene has a density of from 0.82 to 0.95 g/cm$^3$.

5. The three-dimensional structure of claim 4, wherein the polyethylene has a density of from 0.85 to 0.94 g/cm$^3$.

6. The three-dimensional structure of claim 2, wherein the surface layer has a thickness of from 0.3 to 3.5 mm.

7. The three-dimensional structure of claim 2, wherein the surface layer is a laminate material; and the surface layer is bonded to or thermally molded with the plurality of sparse portions and the plurality of dense portions.

* * * * *